US006283037B1

(12) United States Patent
Sclafani

(10) Patent No.: US 6,283,037 B1
(45) Date of Patent: Sep. 4, 2001

(54) NON-LETHAL SHOT-GUN ROUND

(76) Inventor: Procopio J. Sclafani, 109 Thoreau La., Folsom, CA (US) 95630

( * ) Notice: Subject to any disclaimer, the term of this patent is extended or adjusted under 35 U.S.C. 154(b) by 0 days.

(21) Appl. No.: 09/467,373

(22) Filed: Dec. 20, 1999

(51) Int. Cl.[7] ..... F42B 12/40
(52) U.S. Cl. ..... 102/502; 102/513; 102/444
(58) Field of Search ..... 102/501, 502, 102/513, 444

(56) References Cited

U.S. PATENT DOCUMENTS

| | | | | |
|---|---|---|---|---|
| 1,632,156 | * | 6/1927 | Wiley | 102/501 |
| 3,628,225 | * | 12/1971 | Parker | 29/1.3 |
| 3,650,213 | | 3/1972 | Abbott et al. | 102/38 |
| 3,710,720 | * | 1/1973 | Mawinney | 102/42 C |
| 3,865,038 | | 2/1975 | Barr | 102/92.7 |
| 3,911,824 | | 10/1975 | Barr et al. | 102/92.7 |
| 3,983,817 | | 10/1976 | Tucker | 102/41 |
| 4,553,481 | | 11/1985 | Ricci | 102/458 |
| 4,895,076 | * | 1/1990 | Looger et al. | 102/439 |
| 5,121,692 | | 6/1992 | DiCarlo | 102/439 |
| 5,225,628 | | 7/1993 | Heiny | 102/438 |
| 5,370,056 | * | 12/1994 | Huang | 102/353 |
| 5,652,407 | | 7/1997 | Carbone | 102/438 |
| 5,698,816 | | 12/1997 | Roxby | 102/516 |
| 6,164,209 | * | 12/2000 | Best et al. | 102/450 |

* cited by examiner

*Primary Examiner*—Charles T. Jordan
*Assistant Examiner*—Kimberly S Smith
(74) *Attorney, Agent, or Firm*—Thomas Schneck

(57) ABSTRACT

The present invention is a non-lethal shot gun round. The round includes an outer plastic hull inserted into a metal base to form a round casing. Inside the base is a propellent charge. Positioned over the propellent charge is a wad. Above the wad is an elastomeric bag filled with a packed particulate load. In addition a dye may be added into the elastomeric bag to allow marking of the targeted object.

16 Claims, 1 Drawing Sheet

NON-LETHAL SHOT-GUN ROUND

TECHNICAL FIELD OF THE INVENTION

The present invention relates to munitions and specifically pertains to non-lethal ammunition.

BACKGROUND OF THE INVENTION

In law enforcement, penal, self-defense and military tactical situations, there is an increasing demand for non-lethal force options. An increasing emphasis has been placed on the use of non-lethal force in stopping or disabling the targeted individual. The use of non-lethal force has the additional advantage of reducing harm to non-targeted bystanders.

In law enforcement, military and self-defense applications a number of non-lethal force alternatives are currently in use. These include chemical sprays, such as mace or capsicum sprays which are projected in a stream at a potential attacker, and "stun guns" which disable a targeted individual at close range with electrical current. These devices, although achieving non-lethal force, require that an alternative device be used in place of the ordinary weapon. In addition these options are viable only at close range.

Another non-lethal force alternative is the use of ammunition which does not impart lethal force. The use of this ammunition has the advantage that it may be used with conventional firearms. The psychological deterrent of the standard firearm is maintained. The substitution of lethal munitions to replace the non-lethal ammunition in an escalating situation is much more easily effected compared to the stun-gun or chemical spray devices. In addition the range of non-lethal ammunition is much greater, expanding tactical options.

One type of non-lethal ammunition uses a dispersable load to produce a less lethal ammunition. U.S. Pat. No. 3,865,038 to Barr discloses a rifle shell comprised of a rubber housing containing a flowable power, liquid, or gas. The body of the housing has thin rupture zones and thicker reinforcement zones to promote rupture of the bullet at selected locations. The nose portion of the bullet lacks the zones of the body and forms a more rigid piston portion of the bullet. Upon impact, the nose of the housing will be elastic yet resist tearing, while the body of the hosing will tear and impart force. The thicker nose of the bullet ensures that the nose will not rupture, distributing the force of the bullet. A similar piston device is used for signaling artillery shells disclosed in U.S. Pat. No. 3,983,817 to Tucker. This reference describes an artillery shell having a longitudinal internal chamber which opens to the rear of the shell but is closed to the front of the shell by side walls and the shell nose. Positioned within this chamber is an amount of spotting powder. Upon firing, the spotting powder is accelerated to the nose section of the shell. Upon impact, the powder is ejected by the compressed gas in the shell, allowing the location of the shell to be spotted. U.S. Pat. No. 3,650,213 describes ammunition which fires a hollow projectile from a casing. The hollow projectile is assembled of a body having tail fins added for flight stability and a cap. The hollow projectile may be filled with a dispersable substance. The ammunition has a primer and powder charge positioned behind the hollow projectile. The projectile is propelled by the ignited powder charge. When the projectile strikes an object, the hollow projectile will rupture transferring the contents of the hollow projectile onto the object. The cap has rupture zones to aid in the dispersal of the contents of the projectile.

In addition to these piston based ammunition, there are also non-lethal projectiles which may be used. For example, U.S. Pat. No. 5,652,407 to Carbone discloses an ammunition round in which a number of cylindrical projectiles are fired from the round. The projectiles fly in various orientations, striking the target at different locations. The projectiles may be used with an associated dye which marks the target for subsequent identification.

Although several different non-lethal projectiles are known, there is still a need for a non-lethal projectile which is simple to manufacture, has adequate range and accuracy, may be made from conventional materials, and may be fired from conventional weapons.

It is an object of the invention to provide a cost effective shot-gun round which may disable a targeted individual without using lethal force. This round should have adequate accuracy, range and stopping power to be used in tactical situations. It is an additional object of the invention to provide a round of ammunition which may be manufactured with inexpensive, conventionally available materials. It is an additional object of the invention to provide a shot-gun round which leaves a mark on the target for subsequent identification, if desired.

SUMMARY OF THE INVENTION

The above objects are achieved by a new shot-round. The round features an elastomeric sack, such as a latex sack, filled with a packed particulate load, such as sand, sawdust, soil or grease. The round is constructed with a cylindrical base into which a plastic hull is inserted. The plastic hull extends from the bottom of the base to a closed top end of the hull. Within the round, a wad separates the powder propellent within the base and the chamber above the base encased by the hull. The elastomeric sack is located within this chamber. Additionally the elastomeric sack may contain a dye which would leave a mark on the location of impact. The dye may be separated from the particulate load by a membrane.

When the round is fired, a primer within the base ignites the powder with the base. The power explosion causes the wad to project the particle packed elastomeric sack from the hull. The elastomeric sack is sufficiently packed to allow for a relatively long distance, i.e. a few hundred yards, with good accuracy. As the elastomeric bag travels it expands slightly. If a dye is included in the elastomeric bag, the different densities of the dye and the packed particle load cause the two elements to mix within the elastomeric bag. Upon impact, the elastomeric bag disintegrates, spreading the force of the impact over an area of the target. As the elastomeric bag ruptures the packed powder disperses. If a dye is included, the target will be marked with the dye. The round provides a cost effective non-lethal projectile alternative which may be used with conventional shotguns.

DETAILED DESCRIPTION OF THE INVENTION

Figure 1:
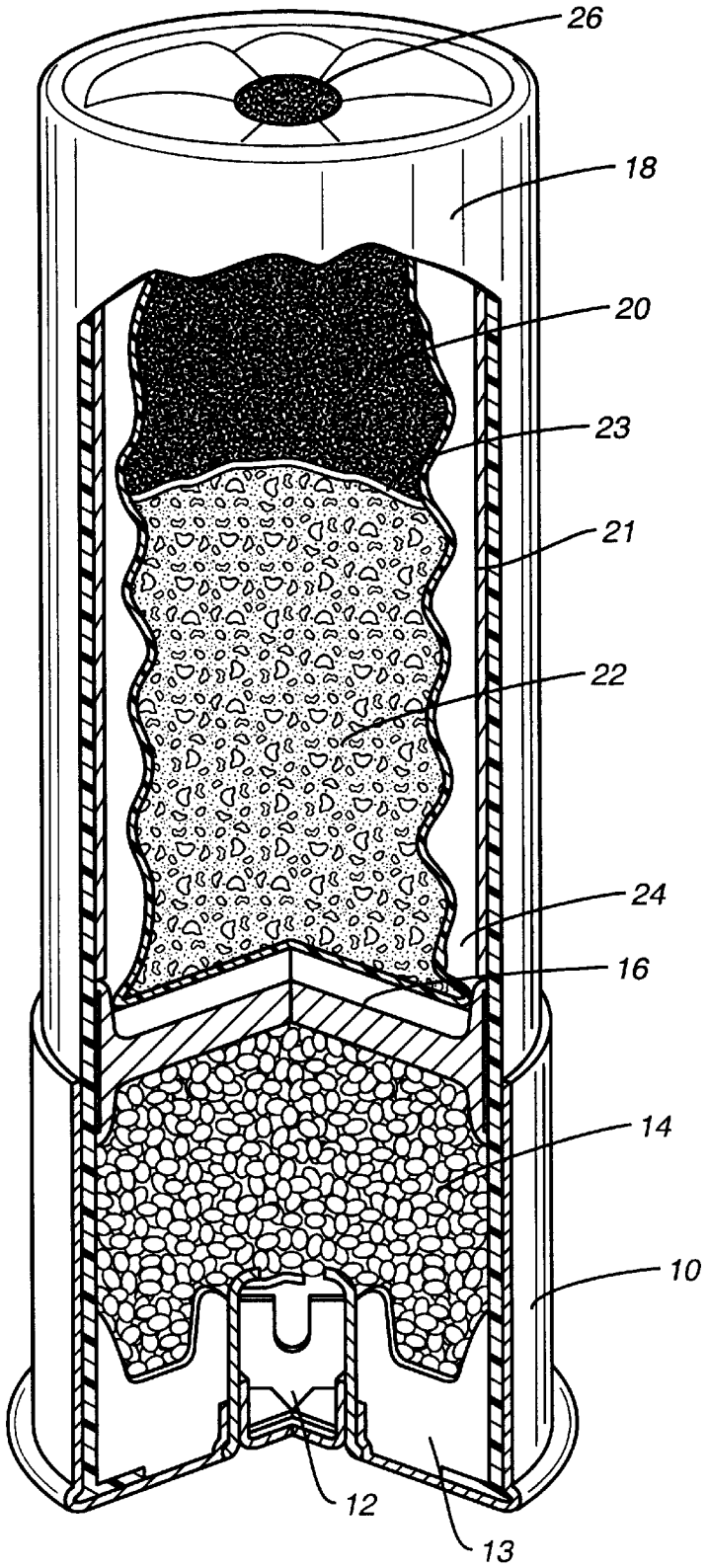
FIG. 1 is a perspective of the shot-gun round of the present invention with an internal cutaway showing internal structure of the round.

In relation to FIG. 1, the shot gun round of the present invention is comprised of a base 10. The base is generally a cylindrical metal casing having an open top section and a closed bottom section. Annularly inserted into base 10 is plastic hull 18. Plastic hull 18 extends into base 10 and folds onto the closed bottom of the base. The top of plastic hull 18 is crimped shut. It is preferred if plastic hull 18 has longitudinal ribbing to improve shot-gun cycling. The insertion of plastic hull 18 into base 10 forms cylindrical round casing having a cylindrical interior cavity.

Inserted into the center of the bottom of base 10 is primer 12. Primer 12 is preferably an all weather lacquer-seal type primer affixed onto base 10. Surrounding primer 12 is powder wad 13. Powder wad 13 is annularly disposed about primer 12. Within the base 10, above the powder wad, is the propellent powder 14. A standard or magnum charge or a desired charge of powder is used. Placed as a cap over the powder propellent charge 14 is a wad 16. Wad 16 forms a barrier between powder propellent 14 and the chamber inside plastic hull 18. It is preferred that a double seal wad is used. A double seal wad contains two wad barriers. The first wad barrier contains a top and bottom annular rim which press against the sides of hull 18. The second wad barrier is fit against the top annular rim of the bottom barrier wad, pressing the wad into the bottom barrier to form a tight seal.

Inside the chamber in plastic hull 18 is an inner cylindrical casing 21 containing the projectile. This projectile is comprised of elastomeric bag 24 packed with high density particulate material 22 and dye 20. The bag may be heat sealed, or otherwise sealed. The elastomeric bag may be comprised of any material which is essentially uniform, would conform to the shape of a chamber or cavity and would allow for expansion in flight. Suitable materials include latex, nitrile and soft plastics. Packed inside the elastomeric bag 24 is the packed particle load 22. In one embodiment the elastomeric bag 24 also contains a dye 20. The packed particle load 22 may be comprised of soil, chalk powder, saw dust, sand, corn starch, talcum powder, polystyrene, any other particulate matter, or any petroleum based material. Each particulate material may be used alone or as a mixture (such as a 50:50 mixture of sand and soil) of multiple particulate materials. The packing of the material into the hull increases the range and ensures a more uniform projectile and a more stable flight. The material should be sufficiently packed so that the elastomeric bag is free standing when packed with the particulate material. The packed particle load should be about 100 grams, but will vary depending on the composition of material selected and the amount of packing included in a round. Additionally, the elastomeric bag may contain a dye. The cylindrical casing 21 containing the elastomeric bag is placed in cylindrical hull 18, an outer casing. The dye may be a liquid or a paste type dye. It is preferred to use less than one ounce of dye for each round. In one embodiment the dye is separated from the particulate load by a membrane. This membrane may be a single sheet. Alternatively the membrane may be a thin bag containing the dye. The dye filled bag would be inserted into the elastomeric bag. If a dye bag is used, a small bubble 26 containing dye may extend through a central hole in the crimped top of hull 18. The dye bubble 26 would then allow ready identification of the round as a non-lethal, dye containing round.

For both the dye and the packed particulate load, it is preferred that non-toxic materials be used, such as dyes or food coloring. These materials are likely to be dispersed into the air upon impact and could be inhaled by the individual proximate to the impact of the projectile.

Upon firing the shot-gun round, the primer 12 ignites the powder propellent 14 exerting a force upon the wad 16. The wad expels the elastomeric bag 24 from the hull 18. The packed particulate load ensures a flight with higher range and greater accuracy. The projectile leaves the shot gun barrel traveling at approximately 400 feet per second. The elastomeric bag expands somewhat in flight. The dye is of a different density than the packed particulate load. The rapid acceleration of the elastomeric bag will cause the dye to mix into the packed particulate load. Upon impact, the uniform elastomeric bag will deform from an elongate projectile to a wider impact surface. The elastomer bag is designed of a uniform material and designed such that the material will rupture upon impact, dispersing the packed particulate matter. The force imparted by the projectile should be sufficient to stun and deter the target. In addition the dye marks the target, allowing subsequent identification or targeting of the target.

The weight of the particulate load is selected to give the load adequate stopping power upon impact. This round may be used both indoors and outdoors against targeted individuals. It is preferred that a standard powder charge be used indoors and a magnum powder charge be used out of doors. For the higher gauges, the projectile may be used indoors for battering of barricades or door and outdoors for longer ranges. In addition to standard shotgun rounds, this ammunition could be used in shotgun like firearms, such as 37/38/40 mm gas gun grenade launcher.

The round provides a non-lethal projectile which would allow in law enforcement or home defense an alternative to lethal force. The projectile would impact with a punch like action which will stun the subject into compliance with instructions. The design allows pin point delivery and greatly lowers the risk of collateral damage. Because the round is designed to maintain the dimensions of ordinary shotgun ammunition, the round may be used in presently deployed shot-gun (including single shot, pump action, and semi-automatic shotguns), with the attendant advantages of low recoil and facilitated cycling of rounds. The round will be all weather ammunition and could be employed in both indoor and outdoor settings. The round will be cost effective in light of the alternative systems presently used which require specialized materials or equipment.

What is claimed is:

1. A non-lethal shot-gun round, comprising:

a first cylindrical casing;

an ignitable propellent charge rearwardly disposed with said first casing;

a wad disposed as a barrier within said first casing forwardly disposed over said propellent charge;

a sealed elastomeric bag composed of a uniform material disposed within said cylindrical casing forwardly located from said wad;

a packed, high density particle load packed within said sealed elastomeric bag;

a dye contained within said elastomeric bag; and a membrane separating said dye from said packed, high-density particle load within said elastomeric bag.

2. The shot-gun round of claim 1 wherein said elastomeric bag is a latex bag.

3. The shot-gun round of claim 1, further comprising an indicator mark on the exterior of said casing indicating the presence of said dye.

4. The shot-gun round of claim 1, wherein said casing is ribbed.

5. The shot-gun round of claim 1, wherein said casing is comprised of a cylindrical base and a plastic hull, wherein said plastic hull is annularly inserted into said base, wherein said base contains said propellent charge.

6. The shot-gun round of claim 5 wherein said plastic hull is crimped at a forward end located distally from said base.

7. The shot-gun round of claim 1 wherein said high density particle load is comprised of a material selected from the group sawdust, sand, and soil.

8. The shot-gun round of claim 1 wherein said high density particle load is comprised of a mixture of particulate materials, at least 50% of which is comprised of a material selected from the group sawdust, sand and soil.

9. The shot-gun round of claim 1 further comprising a second cylindrical casing abutting and within the first cylindrical casing forward of the wad.

10. A non-lethal shot-gun round comprising:

a first cylindrical metal base, said base having a closed bottom surface and an annularly open top;

a plastic hull annularly inserted into said base through said annularly open top extending from the bottom of said base to a crimped end distal from said base;

a power propellent charge located with said base;

a wad located on top of said power charge, said wad confining said charge within said base;

a primer located on the closed bottom surface of said base;

a packed, high density particle load located within said hull; and an elastomeric bag surrounding said packed, high density material, said bag extending from said wad to said crimped end of said hull;

a dye contained within said elastomeric bag; and a membrane separating said dye from said packed, high-density particle load.

11. The shot-gun round of claim 10 wherein said plastic hull is ribbed.

12. The shot-gun round of claim 10 wherein said dye is visible at a location on said crimped end.

13. The shot-gun round of claim 10 wherein said high density particle load is comprised of a material selected from the group sand, sawdust and soil.

14. The shot-gun round of claim 10 wherein the wad is a double seal wad.

15. The shot-gun round of claim 10 further comprising a second cylindrical casing abutting and within the first cylindrical casing forward of the wad.

16. A non-lethal shot-gun round, comprising:

a cylindrical casing;

an ignitable propellent charge rearwardly disposed with said casing;

a wad disposed as a barrier within said casing forwardly disposed over said propellent charge;

a sealed soft plastic bag composed of a uniform material disposed within said cylindrical casing forwardly located from said wad;

a packed, high density particle load packed within said sealed soft plastic bag;

a dye contained within said soft plastic bag; and a membrane separating said dye from said packed, high-density particle load within said soft plastic bag.

* * * * *